US007995781B2

(12) United States Patent
Allegro Baumann et al.

(10) Patent No.: US 7,995,781 B2
(45) Date of Patent: Aug. 9, 2011

(54) METHOD FOR OPERATING A HEARING DEVICE AS WELL AS A HEARING DEVICE

(75) Inventors: Silvia Allegro Baumann, Unterageri (CH); Stefan Daniel Menzl, Jona (CH); Hilmar Meier, Zurich (CH)

(73) Assignee: Phonak AG, Stafa (CH)

( * ) Notice: Subject to any disclaimer, the term of this patent is extended or adjusted under 35 U.S.C. 154(b) by 0 days.

(21) Appl. No.: 12/634,811

(22) Filed: Dec. 10, 2009

(65) Prior Publication Data

US 2010/0092018 A1 Apr. 15, 2010

Related U.S. Application Data

(62) Division of application No. 10/999,474, filed on Nov. 30, 2004, now Pat. No. 7,653,205.

(30) Foreign Application Priority Data

Oct. 19, 2004 (EP) ..... 04024829

(51) Int. Cl.
*H04R 25/00* (2006.01)

(52) U.S. Cl. ..... 381/321; 381/312; 381/317; 381/320

(58) Field of Classification Search ..... 381/313, 381/320–321, 312, 317–318
See application file for complete search history.

(56) References Cited

U.S. PATENT DOCUMENTS

| | | | | |
|---|---|---|---|---|
| 6,661,901 | B1 | 12/2003 | Svean et al. | |
| 6,766,029 | B1 | 7/2004 | Maisano | |
| 6,912,289 | B2 | 6/2005 | Vonlanthen et al. | |
| 7,236,603 | B2 * | 6/2007 | Mergell | 381/312 |
| 7,319,768 | B2 * | 1/2008 | van Oerle | 381/312 |
| 7,340,073 | B2 | 3/2008 | Fischer | |
| 7,343,023 | B2 | 3/2008 | Nordqvist et al. | |
| 7,773,763 | B2 * | 8/2010 | Pedersen | 381/321 |
| 7,826,631 | B2 * | 11/2010 | Fischer et al. | 381/312 |
| 2003/0072465 | A1 | 4/2003 | Fischer et al. | |
| 2003/0091197 | A1 | 5/2003 | Roeck et al. | |
| 2003/0144838 | A1 | 7/2003 | Allegro | |

FOREIGN PATENT DOCUMENTS

| | | | |
|---|---|---|---|
| DE | 4036730 | A1 | 5/1992 |
| EP | 0064042 | A1 | 11/1982 |
| EP | 0674464 | A1 | 9/1995 |
| WO | 9904598 | A1 | 1/1999 |
| WO | 0101731 | A1 | 1/2001 |
| WO | 0122790 | A2 | 4/2001 |
| WO | 0205591 | A2 | 1/2002 |

* cited by examiner

*Primary Examiner* — Curtis Kuntz
*Assistant Examiner* — Ryan Robinson
(74) *Attorney, Agent, or Firm* — Pearne & Gordon LLP

(57) ABSTRACT

In order to switch between different hearing programs to adjust to a momentary acoustic scene, a method for adjusting a hearing device, in which one of several possible hearing programs can be selected in order to adjust to a momentary acoustic scene, the method comprising the steps of detecting a desired hearing program change, changing parameters ($b_1, \ldots, b_m$) of a transfer function provided between a microphone (M1) and a receiver of the hearing device in order to adapt it to the detected hearing program change, adjusting the parameters ($b_1, \ldots, b_m$) to be changed from a momentary value to a desired value in such a manner that a smooth transition is perceived by the hearing device user while changing from a momentary hearing program to the desired hearing program, whereas each of the smooth transition is individually adjustable.

10 Claims, 6 Drawing Sheets

METHOD FOR OPERATING A HEARING DEVICE AS WELL AS A HEARING DEVICE

CROSS-REFERENCE TO RELATED APPLICATION

This application claims priority of European patent application no. 04 024 829.6 filed on Oct. 19, 2004, which application is incorporated herein by reference in it's entirety for all purposes.

TECHNICAL FIELD OF THE INVENTION

The present invention is related to a method to operate a hearing device, in which the possibility is given to select a specified hearing program according to a momentary acoustic scene, as well as to a hearing device.

DESCRIPTION OF THE RELATED ART

Modern hearing devices can be adjusted to different acoustic scenes by selecting a hearing program that is best suited for the momentary acoustic scene. Thereby, the operation of the hearing device is adjusted optimally to the needs of the user of the hearing device.

A hearing program can either be selected manually by a remote control or over a switch at the hearing device itself or automatically without user interaction. A manual switching from one hearing program to another is performed in an abrupt manner in that the parameters of the momentary used hearing program are changed within a short time. As a result thereof, a sudden hearing quality change occurs, which is perceived by the hearing device user and which is sensed as unnatural. This is in particular the case if such sudden switching of hearing programs takes place automatically—for example as described in international patent application WO 01/22790, in which a classifier is disclosed to automatically determine the momentary acoustic scene and therewith the corresponding hearing program. The use of such a classifier results in switching between hearing programs at an unexpected point in time. It is well known that for an automatic switching from one hearing program, which weights the received acoustic signals according to their direction of occurrence (so-called "beam former"), to an other hearing program, which does not perform any direction-dependent weighting, a sudden and unexpected quality change occurs that can be clearly heard by the hearing device user who is quite often confused about the sudden change of the hearing program.

From the European patent having the publication number EP-B1-0 064 042, a hearing device is known that incorporates the aforementioned drawbacks resulting from an abrupt switching from one hearing program to another.

Furthermore, reference is made to the European patent application having the publication number EP-A1-0 674 464, in which a hearing device is described having a controller that alters one or several parameters of the transfer function as a function of input values of the momentary acoustic scene by applying the principle of fuzzy logic. The alteration of the parameters is thereby suddenly carried out and in direct dependency of the momentary acoustic scene or according to simplified assumptions, respectively.

In U.S. patent application having the Ser. No. 10/044,701, a hearing device incorporating a smooth transition is proposed if a switching from one hearing program to another must be performed. The parameters to be changed as a result of a hearing program switching are smoothly adjusted from the momentary values to the desired values. The smooth transition is obtained by using corresponding first order low-pass filters, in which the time constants are identical for all transitions.

SUMMARY OF THE INVENTION

It is an objective of the present invention to provide a simple and improved method for switching from one hearing program to another.

The foregoing and other objects of the invention are achieved by adjusting a hearing device, in which one of several possible hearing programs can be selected in order to adjust to a momentary acoustic scene, by the following steps:

- detecting a desired hearing program change,
- changing parameters of a transfer function provided between a microphone and a receiver of the hearing device in order to adapt it to the detected hearing program change,
- adjusting the parameters to be changed from a momentary value to a desired value in such a manner that a smooth transition is perceived by the hearing device user while changing from a momentary hearing program to the desired hearing program, whereas each of the smooth transition is individually adjustable.

In addition, a method for adjusting a hearing device, in which at least one of several possible hearing device functions can be selected, is disclosed, the method comprising the steps of:

- detecting an activation of a hearing device function,
- changing parameters of a transfer function provided between a microphone and a receiver of the hearing device in order to adapt it to the detected activation of a hearing device function,
- adjusting the parameters to be changed from a momentary value to a desired value in such a manner that a smooth transition is perceived by the hearing device user while activation of the hearing device function takes place, whereas each of the smooth transition is individually adjustable.

In the context of the present invention the term "parameter" not only means single coefficient values of a transfer function of a hearing device, but also signals as described e.g. in connection with the embodiments according to FIG. 1 or 2.

It is a further objective to improve hearing devices with automatic acoustic scene detection in the sense that the hearing device user is less confused by automatic switching of hearing programs in noisy environment.

The foregoing and other objective are achieved by adjusting a hearing device, in which one of several possible hearing programs can be selected in order to adjust to a momentary acoustic scene, by the following steps:

- extracting features from an input signal to the hearing device in an feature extracting stage,
- classifying the features in a feature classification stage into at least one raw sound class,
- post processing the at least one raw sound class into a post processed sound class,
- selecting a hearing program to operate the hearing device according to the post processed sound class.

BRIEF DESCRIPTION OF THE DRAWINGS

Preferred embodiments of the present invention are hereinafter described by way of example referring to the following drawings, in which.

DETAILED DESCRIPTION OF THE INVENTION

Figure 1:
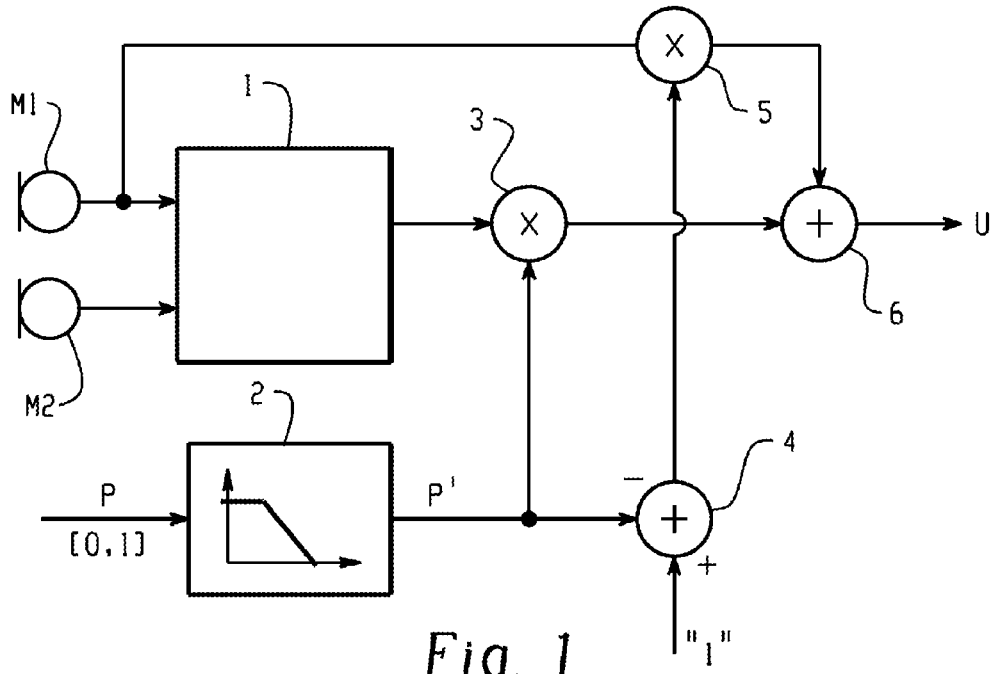
Fig. 1 PRIOR ART
FIG. 1 shows a block diagram of a known arrangement for a hearing device with direction-dependent characteristics.

FIG. 1 shows a block diagram of a part of a known hearing device having two microphones M1 and M2 for recording acoustic signals. The hearing device is able to process direction-dependent information, which means that for such a known hearing device the possibility is given to treat acoustic signals coming from a certain direction in a preferred manner compared to acoustic signals coming from another direction. On the other hand, there is a need that, under certain circumstances, direction-dependent processing of recorded acoustic signals is not wanted. In this case, it is provided that the direction-dependent processing of the signals is being switched off. This can be reached in particular by switching off one of the two microphones M1 and M2, respectively, which results in the processing of only one acoustic signal in the hearing device.

In FIG. 1, the input stage of such a known hearing device is depicted. The two outputs of the microphones M1 and M2 are being fed to a signal processing unit 1, in which the signals—whether they are available in digital or in analog form—are being processed in a so-called "beam forming"-algorithm. Further information regarding beam forming-algorithms is disclosed, for example, in the international patent application having the publication number WO 99/04598 or in its corresponding U.S. patent with publication number U.S. Pat. No. 6,766,029.

If the "beam forming"-algorithm is active, the output signal of the signal processing unit 1 only contains the acoustic signal that comes from the desired direction. This direction dependent signal is treated in further processing units (not shown in FIG. 1) of the hearing device before being fed to the receiver of the hearing device (not shown in FIG. 1). The further processing unit comprises algorithms adapted to improve the hearing of a specific hearing device user and therefore incorporates processing to overcome an individual hearing loss, for example.

According to FIG. 1, a first and a second multiplicator unit 3 and 5, respectively, as well as a first and a second summator unit 4 and 6 are being provided to switch on and to switch off, respectively, the consideration of direction-dependent information. By P, a switching state is described that has the values "0" or "1", whereas the momentary switching state P is fed to a filter unit 2. The output signal of the filter unit 2 is fed to the first summator unit 4—after having reversed its algebraic sign—as well as to a first multiplicator unit 3, to which also the output signal of the signal processing unit 1 is being fed. The constant value "1" is being fed to the first summator unit 4 as second input signal. Furthermore, the output signal of the first summator unit 4 is being fed to the second multiplicator unit 5 having a second input signal, to which the first microphone M1 is connected. Finally, the output signals of the first and the second multiplicator unit 3 and 5, respectively, are fed to the second summator unit 6 in order to obtain an output signal u that—as has already been stated above—is being further processed in further processing units of the hearing device, if need be, before being fed to the receiver of the hearing device.

In the following, the functionality of this known hearing device is described:

If the switching state P has the value "0", the acoustic signal recorded by the microphone M1, assuming steady state, is being switched through to the output u without being further processed. In other words, a hearing program is provided that does not take into consideration any direction-dependent information, i.e. all signals being picked-up by the microphone M1 are treated equally, independent of their angle of incidence. Such a signal is also identified by the term "omni signal". The corresponding hearing program may be named accordingly.

If the switching state P has the value "1", the reverse case occurs, assuming again steady state: Instead of the switching-through of the output signal of the microphone M1 alone to the output signal u, the output signal already generated in the signal processor unit 1 is now switched through to the output u. Thereby, a signal is provided in this switching state P as output signal u that incorporates a specific, namely direction-dependent, signal. The output signal u is also identified by the term "directional signal". The corresponding hearing program may be named accordingly or may be named "beam former".

As has already been described, the switching from one hearing program to another, i.e. from the "omni signal" to the "directional signal" and vice versa, can result in confusion of the hearing device user, when the switching is done automatically, i.e. without any ado by the hearing device user, in other words, if the switching is a surprise for the hearing device user. In order to eliminate the surprising effect on the hearing device user, a smooth transition is arranged for a state change of a switching state P in order to obtain a smooth transition from an "omni signal" to a "directional signal" and vice versa, respectively. Thereto, a low-pass filter of first order is provided in the filter unit 2, which low-pass filter preferably has a time constant of approx. 1 second.

The filter unit 2 causes a weighting of the outputs of the signal processing unit 1 and of the first microphone M1 in that the output of the signal processing unit 1 is directly multiplied by the output signal of the filter unit 2, in that, furthermore, the output of the first microphone M1 is multiplied by the inverted output of the filter unit 1, which output is being increased by the value of "1", and in that, finally, the two weighted signals are added together in the second summator unit 6. The values of the switching state P are equal to "0" or equal to "1" as can be seen from FIG. 1. Accordingly, also the output signal of the filter unit 2 is within this range, but all values between the two extreme values can be adapted.

Figure 2:
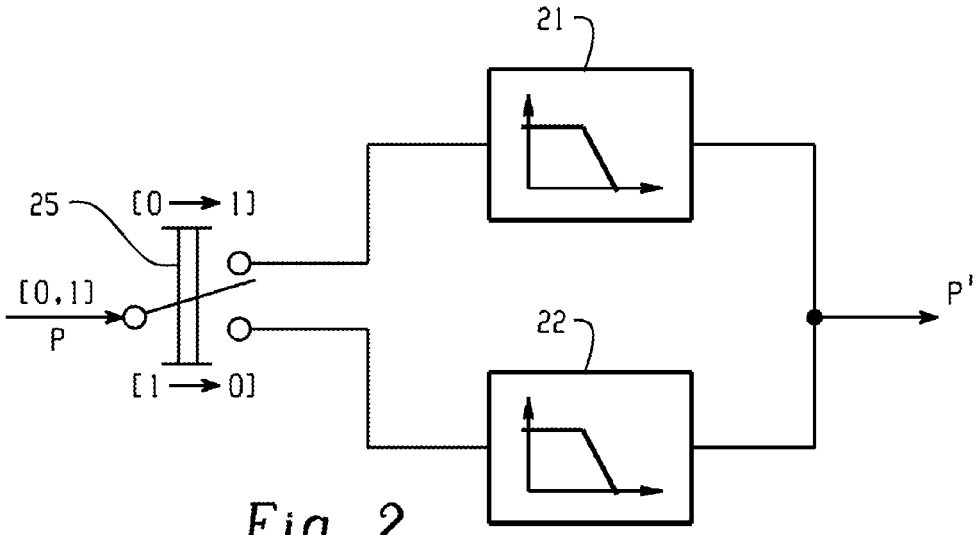
FIG. 2 shows a block diagram in part of an arrangement according to the present invention, in which a single parameter of a hearing device transfer function is smoothly adjusted.

FIG. 2 shows a partial block diagram of a first embodiment of a hearing device according to the present invention. The inventive embodiment follows the example depicted in FIG. 1. In contrast thereto, the filter unit 2 is replaced by filter units 21 and 22 as well as a switching unit 25, which has the switching state P as input signal. The switching unit 25 is able to feed the input signal either to the filter unit 21 or to the filter unit 22. Both output signals of the filter units 21 and 22 are connected together to form the switching state P' that is further processed in the same manner as has been described in connection with FIG. 1.

The filter unit 21 is a low pass filter, for example, to control the transition [0→1], as it is indicated above the switching unit 25 in FIG. 2, whereas controlling the transition means applying a predefined signal delay for the switch-on procedure. On the other hand, the filter unit 22 is also a low pass filter, for example, to control the transition [1→0], as it is indicated below the switching unit 25 in FIG. 2. In other words, the present invention proposes to allow different time constants for the two transitions.

The present invention opens up the possibility to adjust the time constants of the filter units or of parameters, respectively, individually, eliminating therewith a fast and continuous switching between different hearing programs that is normally perceived as very disturbing.

Figure 3:
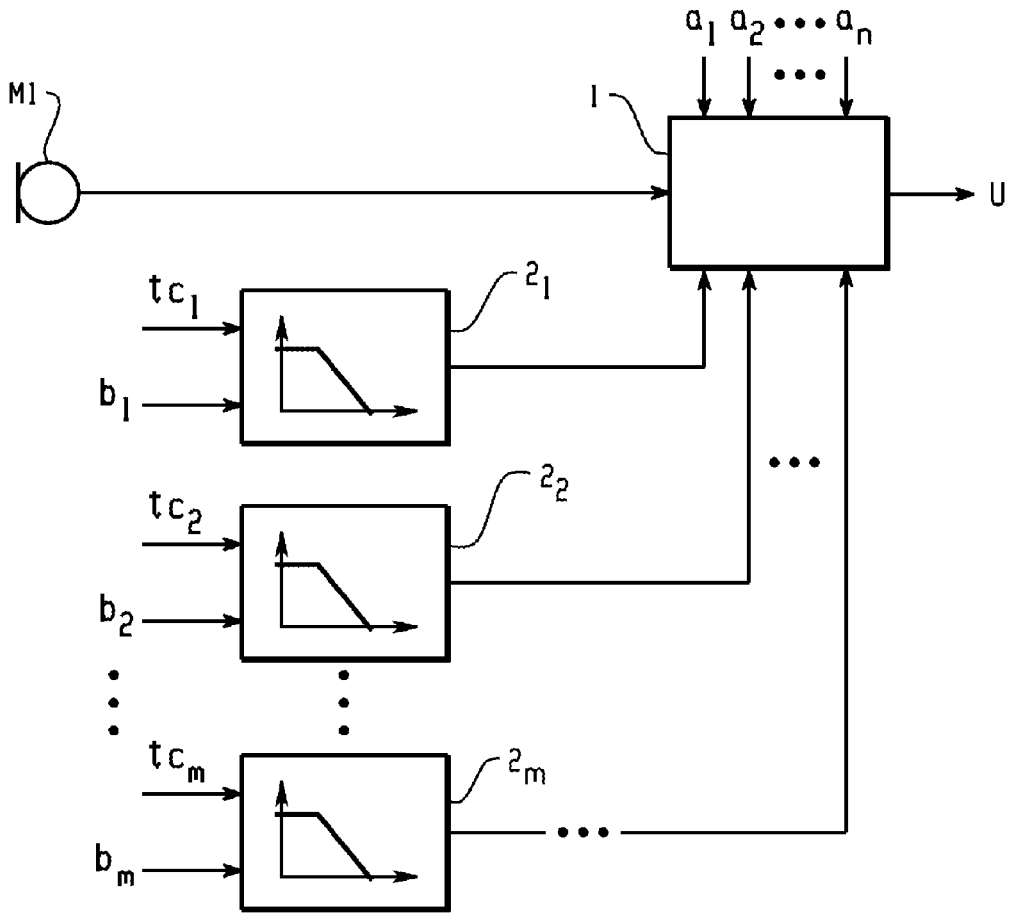
FIG. 3 shows a block diagram of a further arrangement according to the present invention.

FIG. 3 shows a block diagram of a further embodiment of a hearing device according to the present invention. The block diagram is again shown in part and schematically. In this embodiment of the present invention, an algorithm for noise canceling is being used. Therefore, a transfer function is determined in the signal processing unit 1, in which an input signal from the microphone M1 is being processed. Output signal u of the signal processing unit 1 is treated, as already mentioned in connection with the embodiment of FIG. 1, in further processing units of the hearing device, if need be, and is being finally fed to the receiver of the hearing device.

The transfer function generated in the signal processor unit 1 has a number of parameters $a_1$ to $a_n$ and $b_1$ to $b_n$, respectively, whereas the parameters $a_1$ to $a_n$ remain unchanged if another hearing program is selected. The parameters $b_1$ to $b_n$ are being changed if another hearing program is selected. According to the present invention, filter units $\mathbf{2}_1$, to $\mathbf{2}_n$ are provided as a consequence to the description of the embodiment according to FIG. 1. The filter units $\mathbf{2}_1$ to $\mathbf{2}_n$ have input values corresponding to the parameters $b_1$ to $b_n$ in order to obtain a smooth transition from the momentary value of a parameter to a predefined target value. The filter units $\mathbf{2}_1$ to $\mathbf{2}_n$ have further input signals $tc_1$ to $tc_m$ that can be adjusted by a central processing unit (not shown in FIG. 3) of the hearing device. The values for the input signals $tc_1$ to $tc_m$ correspond to the respective time constant for a transition. The values can be changed at any point in time by the central processing unit, therewith allowing an adjustment to a specific on-going or planned smooth transition. In particular, the values for the input signals $tc_1$ to $tc_m$ may be different for an activation transition than for a deactivation transition of a particular hearing program or function. The parameter values being smoothed in the filter units $\mathbf{2}_1$ to $\mathbf{2}_m$ in accordance with the desired time constants, i.e. according to the values of the input signals $tc_1$ to $tc_m$, as well as the unchangeable values of the parameters $a_1$ to $a_n$ are being fed to the signal processing unit 1, in which the transfer function is determined and applied to the signal coming from the microphone M1.

Figure 4:
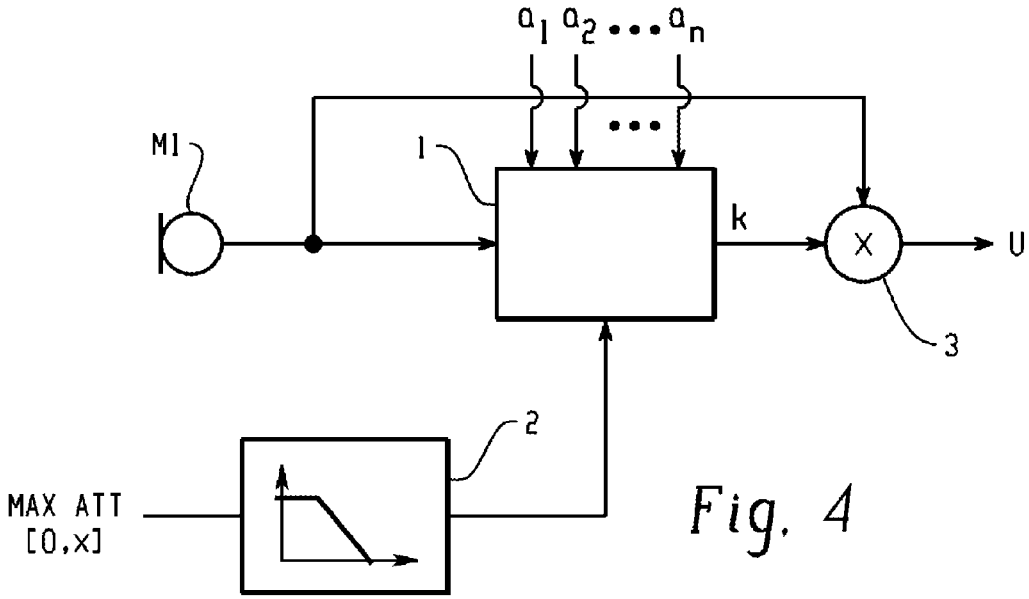
FIG. 4 shows a block diagram of a further arrangement according to the present invention, in which a single parameter is smoothly adjusted.

For further explanation of the more general embodiments of the invention according to FIG. 3, a specific embodiment of the invention is shown in FIG. 4. Besides the parameters $a_1$ to $a_n$, which experience no change by switching from one hearing program to another, a parameter MaxAtt is adjustable. Thereby, the parameter MaxAtt obtains either the value of "0" or the value x. For the use of an algorithm to suppress noise, the parameter MaxAtt corresponds to the maximum attenuation of a noise suppression of the type "spectral subtraction", which is applied to increase the signal-to-noise ratio (SNR).

In contrast to the embodiment of FIG. 3, the output signal u is not directly determined by the signal processing unit 1 in the embodiment of FIG. 4, but an attenuation factor k is determined using the signal processing unit 1. The attenuation factor k is applied to the output signal of the microphone M1 over a multiplicator unit 3. The output signal of the multiplicator unit 3 corresponds then to the signal u, which is further processed, as the case may be, according to the above mentioned explanation.

The filter unit 2 can be realized the same way as the one explained in connection with FIG. 3.

Furthermore it is feasible that the two embodiments of the invention according to FIG. 2 and according to FIGS. 3 and 4, respectively, are combined.

In dependence on the aforesaid explanations, it is provided that a smooth transition is generated in the sense of the above explanation whenever an automatic hearing program switching occurs. In other words, the switching state P according to FIG. 2 is being undertaken automatically with the aid of an algorithm to recognize the momentary acoustic scene. In connection with the recognition of the momentary acoustic scene, reference is made to the two U.S. patent applications with the publication numbers US 2002/0037087-A1 and US 2002/0090098-A1, which contents are herewith incorporated by reference.

In a further embodiment of the present invention, it is provided that the values for the switching state P can take any values in the range between "0" and "1".

It is pointed out that basically all parameters, which are changed within the scope of a hearing program switching, may obtain a smooth transition according to the present invention. As examples, the following parameters are mentioned which are processed either alone or in combination according to the aforesaid explanations:

- maximum attenuation;
- width of registration, i.e. direction sharpness of a beam former;
- amplification;
- compression;
- scaling;
- operating point of a noise suppression unit according to FIG. 4;
- time constant of the compression;
- compression knee point;
- limiter;
- operating point of the suppression unit for the signal feedback;
- operating point of a recognition unit of the acoustic surrounding;
- etc In general, a smooth transition can be defined by an adjustable period, during which the transition takes place. This may well be the beginning of a value change of a single parameter of the hearing device transfer function until the end of the value change of the same parameter, as it has been described in the above-mentioned embodiments.

In addition, the adjustable period may also depend on the momentary selected hearing program or on the momentary detected acoustic scene, respectively. It is expressly pointed out that it is important according to the present invention that the hearing device user perceives a smooth transition when a hearing program change occurs or when a hearing device function is activated. A smooth transition is particularly relevant when an automatic hearing program change occurs, and a smooth transition is less important when a manual hearing program change is initiated because in the latter case, the hearing device user is prepared for a different hearing perception. In addition, the hearing device user wants to have a direct perceivable feedback as soon a manual switching has been initiated. In any event, also a smooth transition is preferred in the latter case, the time constants being though significantly smaller (for example in the order of 5 milliseconds) for a manual hearing program change than the time constants for an automatic hearing program change (fading time constants can be set between 0.5 and 3 seconds, for example). A hearing program change does not ask for all parameters of a hearing device transfer function to be smoothly changed. It may well be that only a few parameters are smoothly changed in the above-mentioned sense during the switching or activation procedure.

In the embodiment of FIG. 2, a low pass filter unit is used to generate a smooth transition from one state to the other. Instead of a filter unit, a ramp generator can also be used, the ramp generator preventing any sudden change of parameters in order that the hearing device user perceives a smooth transition.

Possible hearing device functions may be the following:

- beam former;
- noise cancellers, including wind noise and reverberation cancellers;
- adjustments of gain models;
- adjustments of feedback cancellers (less aggressive for music);
- adjustments of limiters;
- selected input (microphone, T-coil, audio input, etc.);
- etc.

In the automatic mode, a classifier analyzes the acoustic scene and sends its decision of what the current sound situation is to the controller, where the corresponding hearing program is automatically activated. A smooth transition or soft fading of the parameters of the involved signal processing (e.g. gain model, noise canceller, beam former, etc.) takes place as described above. According to a further aspect of the present invention, the classifier detecting a new momentary acoustic scene has also time constants which influence the switching time. These time constants can also be different in dependence on the detected acoustic scene. This will be further explained by referring to FIGS. 5 to 9.

Figure 5:
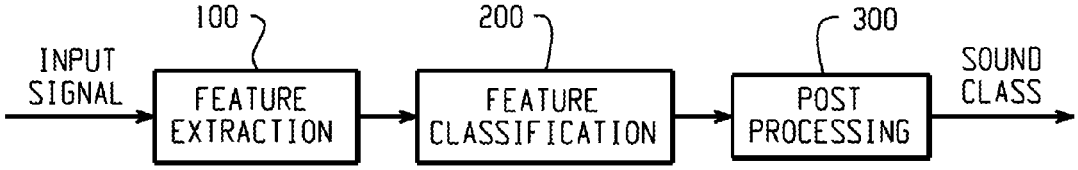
FIG. 5 shows a block diagram of a classifier comprising an extraction stage, a classification stage and a post processing stage.

FIG. 5 shows a simplified structure of a classifier, comprising three major stages: extraction of characteristic features of an input signal in an extraction stage 100, classification of the features into different sound classes in a classification stage 200, and post processing for correcting classification errors and smoothing the classifier output in a post processing stage 300.

Figure 6:
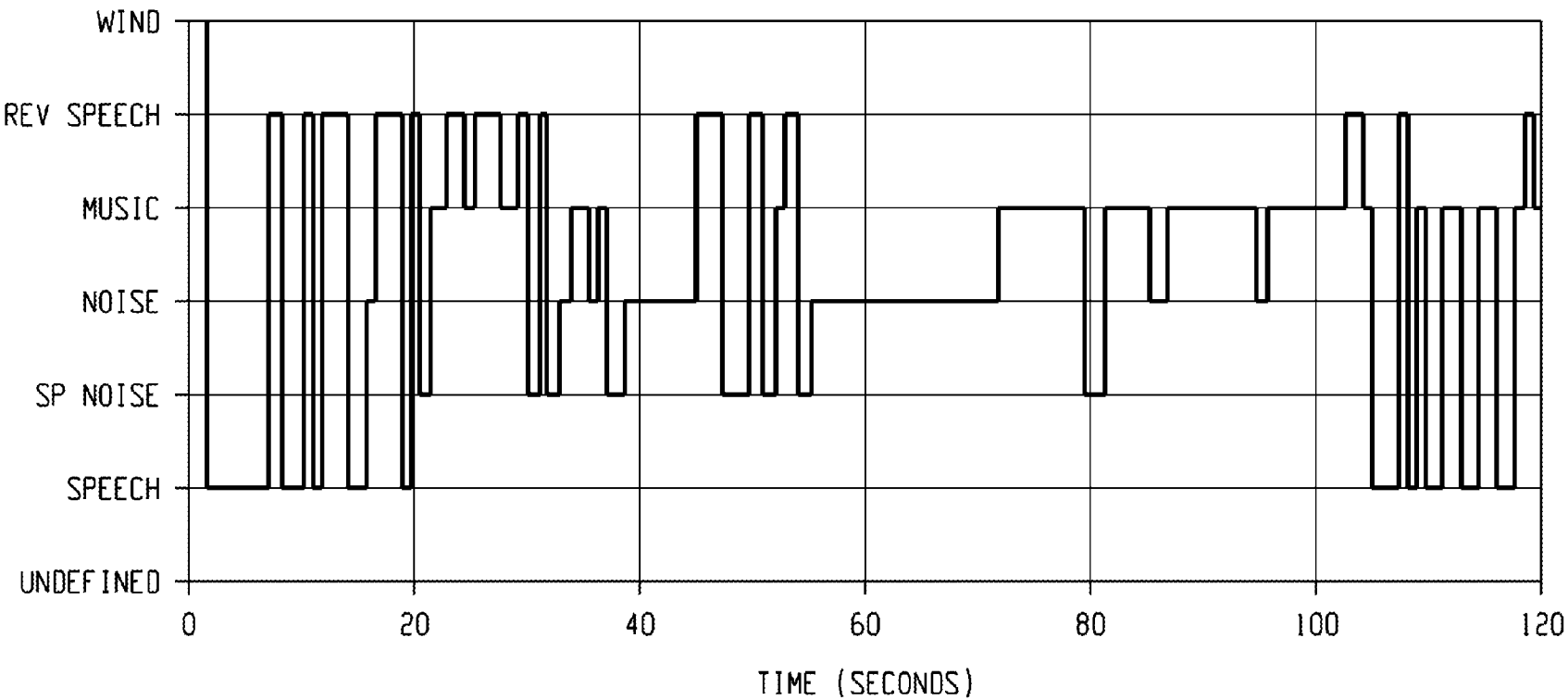
FIG. 6 shows a course of detected raw sound classes as a function of time.

An example for raw sound classes obtained after the feature classification stage 200 but before the post processing stage 300 is depicted in FIG. 6. Possible sound classes in this example are:

- wind;
- reverberated speech (referred to "RevSpeech" in FIGS. 6 to 9);
- music;
- noise;
- speech in noise (referred to "SpNoise" in FIGS. 6 to 9);
- speech; and
- undefined.

From FIG. 6, it becomes clear that switching between different sound classes occurs rather often. In order to reduce possible confusion of the hearing device user because of the high switching rate between detected sound classes, a post processing is applied in the post processing stage 300.

Figure 7:
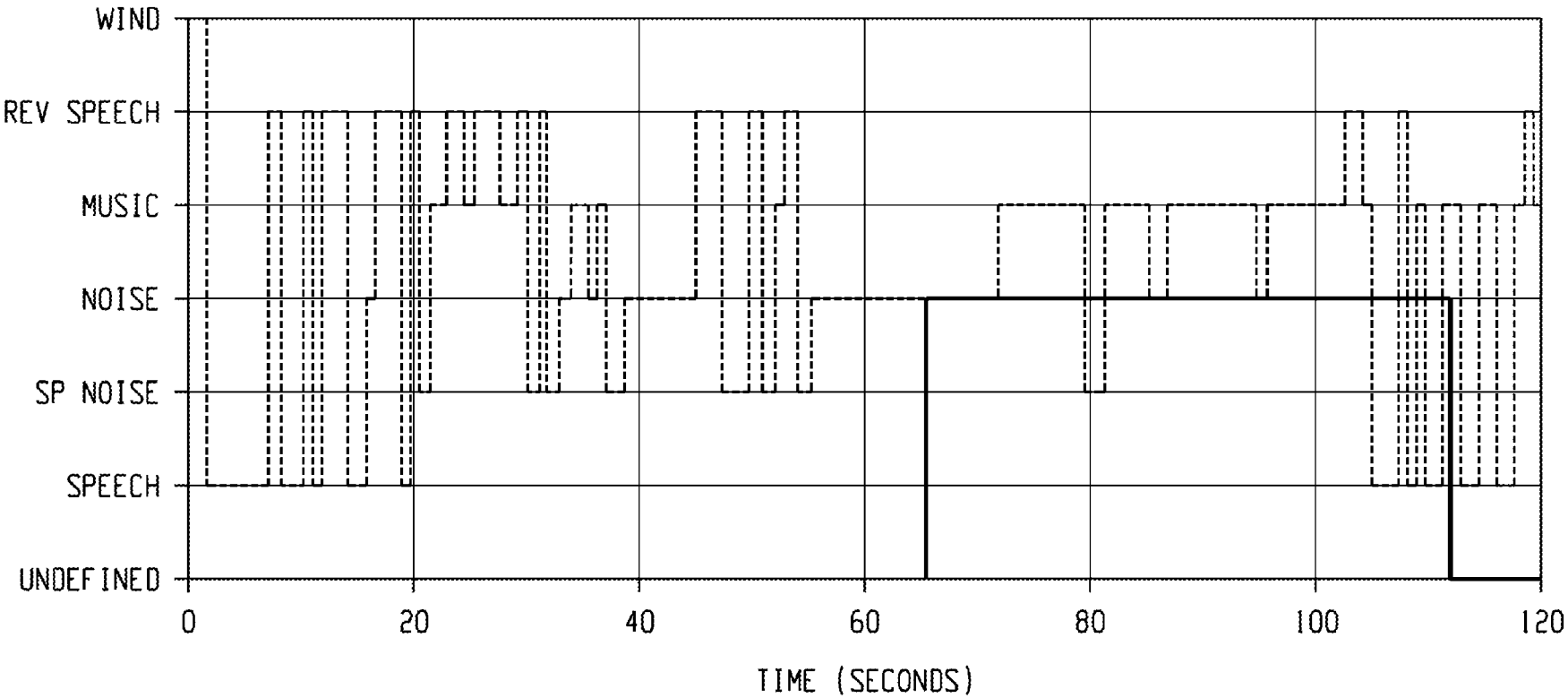
FIGS. 7 to 9 show several courses of applied sound classes after post processing of the raw sound classes.
Figure 8:
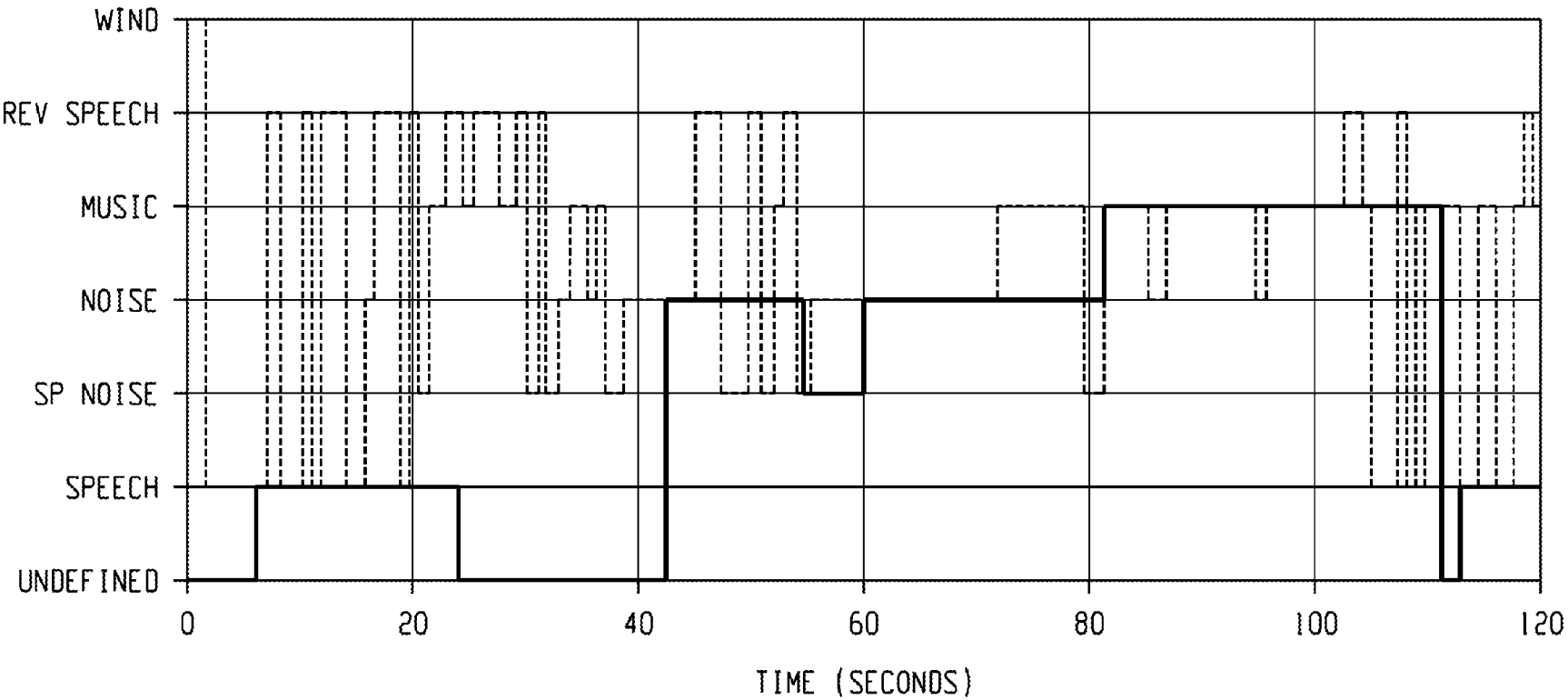
Figure 9:
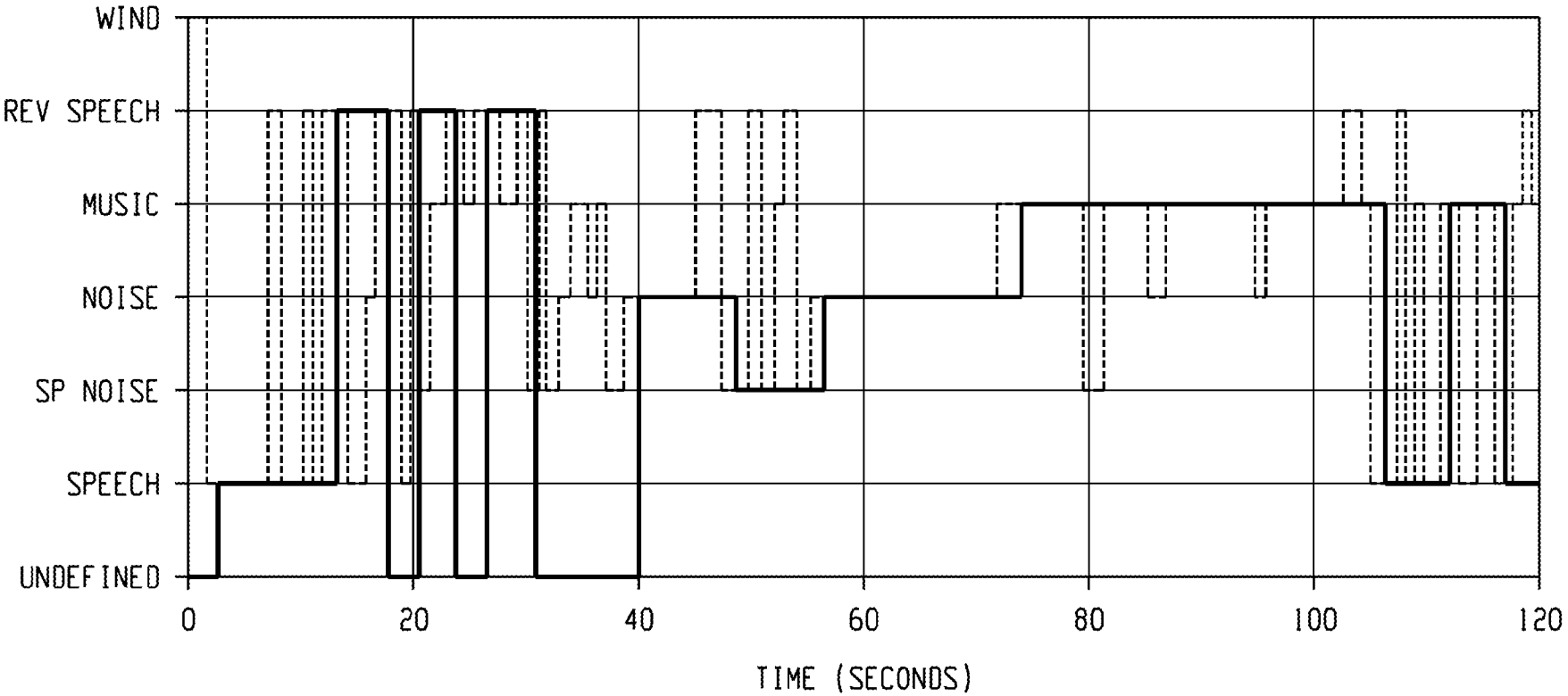

After post processing, the output sound class can look e.g. as depicted in FIGS. 7 to 9. Here, three different time constants have been applied: slow (FIG. 7), medium (FIG. 8), and fast (FIG. 9). It is apparent from these examples that the post processing highly influences the outcome of the overall classifier, i.e. the recognized sound class at the output of the post processing stage 300. A long time constant result in leaving out some of the sound classes detected in the classification stage 200. Therefore, a rather long time constant results in obtaining a stable output, fast time constants lead to switching between classes more often.

In the post processing stage 300, several parameters can be set that influence the switching time of the classifier. As for the soft switching, the post processing time constants can be set individually for each sound class respectively hearing program. For example, the following parameters can be set individually for each sound class:

- length of time window (post processing window length);
- probability threshold;
- hysteresis for switching of class ('hold time').

Hence, the classifier parameters "length of post processing window", "probability thresholds" and "hold times" influence how fast a class is recognized, and how fast it is replaced by another class or by an undefined class.

All in all, one can thus distinguish four types of time constants that influence the change of hearing programs: time constant for activation sound class in classifier (classifier time constants), time constant for deactivation of sound class in classifier (also called classifier time constant but the value may be different from the value for the first mentioned classifier time constant), time constant for activation of a hearing program (or hearing device function) in the hearing device (soft fading time constant), and time constant for deactivation of a hearing program (or hearing device function) in the hearing device (also called soft fading time constant but the value may be different from the value of the first mentioned soft fading time constant).

One embodiment of the present invention incorporates the implementation of both the soft fading time constants and the classifier time constants for activating and deactivating bound classes not fixed but variable for different acoustic scenes respectively different hearing programs and/or functions. For example, if one switches into a hearing program for clean speech or speech in noise, it is advantageous if this can happen as fast as possible. On the other hand, when one is in the music program one does not want this to be switched off often by short disturbances such as, for example, slamming doors, and therefore one would select a longer deactivation time for the class music than e.g. for the class speech.

Further embodiments of the present invention may only incorporate the aspect of soft fading time constants or only the aspect of classifier time constants, but not both, in order to only obtain the respective advantages referred to above.

It is further pointed out that the present invention is not only directed to hearing devices that are used to improve the hearing of hearing impaired patients. The present invention can very well be used in connection with any communication device, be it wired or wireless, or in connection with any hearing protection device.

The invention claimed is:

1. A method to adjust a hearing device, in which one of several possible hearing programs can be selected in order to adjust to a momentary acoustic scene, the method comprising the steps of

- extracting features from an input signal in an feature extracting stage,
- classifying the features in a feature classification stage into at least one raw sound class,
- post processing the at least one raw sound class into a post processed sound class in a post processing stage, the post processing including applying a classifier time constant for activating or deactivating the post processed sound class, and selecting a hearing program to operate the hearing device according to the post processed sound class.

2. The method of claim 1, wherein undesired switching between sound classes is prevented by the post processing step.

3. The method of claim 1, wherein during said classifier time constant a switching between sound classes is being prevented.

4. The method of claim 1, wherein a value of the classifier time constant depends on a detected sound class.

5. A hearing device comprising at least one microphone, a receiver, a signal processing unit operationally connected between the at least one microphone and the receiver, means for extracting features from an output signal of the at least one microphone, means for classifying the extracted features into at least one raw sound class, means for post processing the at least one raw sound class into a post processed sound class, the post processing including applying a classifier time constant for activating or deactivating the post processed sound class, and means for selecting a hearing program to operate the hearing device according to the post processed sound class.

6. The hearing device of claim 5, wherein the means for post processing prevent undesired switching between sound classes.

7. The hearing device of claim 5, wherein during the classifier time constant a switching between sound classes is prevented.

8. A hearing device comprising at least one microphone, a receiver, a signal processing unit operationally connected between the at least one microphone and the receiver, means for extracting features from an output signal of the at least one microphone, means for classifying the extracted features into at least one raw sound class, means for post processing the at least one raw sound class into a post processed sound class, and means for selecting a hearing program to operate the hearing device according to the post processed sound class, wherein the means for post processing apply a classifier time constant during which a switching between sound classes is prevented, wherein the classifier time constants are individually adjustable for each sound class or sound class transition, respectively.

9. The hearing device of claim 5, wherein a value of the classifier time constant depends on a detected sound class.

10. The hearing device of claim 7, wherein classifier time constants are individually adjustable for each sound class or sound class transition, respectively.

* * * * *

UNITED STATES PATENT AND TRADEMARK OFFICE

CERTIFICATE OF CORRECTION

PATENT NO. : 7,995,781 B2
APPLICATION NO. : 12/634811
DATED : August 9, 2011
INVENTOR(S) : Silvia Allegro Baumann et al.

It is certified that error appears in the above-identified patent and that said Letters Patent is hereby corrected as shown below:

In the Specification, column 8, line 36, replace “bound” with -- sound --

Signed and Sealed this
Eighth Day of November, 2011

David J. Kappos

David J. Kappos
*Director of the United States Patent and Trademark Office*